US006450107B1

(12) United States Patent
Sanz Novales

(10) Patent No.: US 6,450,107 B1
(45) Date of Patent: Sep. 17, 2002

(54) OFFICE TABLE

(75) Inventor: Alberto Sanz Novales, Vitoria-Alava (ES)

(73) Assignee: OFITA, S.A. Mobiliario Metalico, Victoria-Alava (ES)

( * ) Notice: Subject to any disclaimer, the term of this patent is extended or adjusted under 35 U.S.C. 154(b) by 0 days.

(21) Appl. No.: 09/695,854

(22) Filed: Oct. 26, 2000

(30) Foreign Application Priority Data

Oct. 27, 1999 (ES) ..... 9902700

(51) Int. Cl.[7] ..... A47B 13/00
(52) U.S. Cl. ..... 108/153.1
(58) Field of Search ..... 108/153.1, 158.12, 108/157.12, 115, 157.1, 156, 187, 188, 186

(56) References Cited

U.S. PATENT DOCUMENTS 1,731,920 A * 10/1929 Boettger ..... 108/153.1
4,163,537 A * 8/1979 Mourgue ..... 108/158.12 X
4,242,969 A * 1/1981 Checkwood et al. ..... 108/156
4,585,365 A * 4/1986 Manno ..... 108/153.1 X
4,630,550 A * 12/1986 Weitzman ..... 108/186 X
4,731,918 A * 3/1988 Burghardt ..... 108/156 X
5,289,784 A * 3/1994 Waibel ..... 108/157.1
5,421,273 A * 6/1995 Lin ..... 108/187
5,802,990 A * 9/1998 Lin ..... 108/157.1
5,934,203 A * 8/1999 Glass ..... 108/156

* cited by examiner

*Primary Examiner*—Jose V. Chen
(74) *Attorney, Agent, or Firm*—Young & Thompson

(57) ABSTRACT

The table includes tubular legs and nodes or technical pieces having a bottom arm to be plugged into the tubular legs and lateral slots for the tongued and grooved coupling of pieces at the end of arms constituted in pairs and connected to each other, those of one pair to the ones of the other pair by means of an intermediate tensor rod so as to configure a horizontal structure associated to the legs. A board is screwed both to the nodes and to the intermediate frame, particularly to plates connecting each pair of arms to the intermediate tensor rod.

5 Claims, 3 Drawing Sheets

OFFICE TABLE

OBJECT OF THE INVENTION

The present invention relates to a table specially conceived as a piece of furniture, although it can also be used obviously for any other purpose to which it could be considered appropriate, said table being detachable in such a way that the different elements integrating the same can be packed and stored within a minimal volume space and offering subsequently a quick and simple assembling ensuring also an optimal structural strength.

DESCRIPTION OF THE INVENTION

To achieve this, more particularly, the table of the invention is essentially structured by means of the functional combination of a working board, four legs and a frame; four nodes or technical pieces collaborate with said elements and constitute the fixation means of both the working board and the frame to the legs, while the same working board is also fixed to the frame.

For this purpose, the legs are tubular, they have a leveling piece at their bottom end and they receive at their upper end, by plugging means, an arm being the elongation of the correspondent node or technical piece, said arm being definitely fixed to the support by means of screws which are accessible through a lateral slot of the support, located in correspondence with one of its surface lines and closed by means of a complementary profile that can be coupled thereto by pressure; said longitudinal slot gives access to the screw heads and allows the introduction of power cables for possible equipment to be placed on the working board.

Each one of the nodes or technical pieces has, on its lateral surface, a plurality of slots presenting a throttled opening, specifically three of them, distributed at 90°, in such a way that the slots allow the nodes of the frame to be fixed, at both the right or the left side; they optionally allow to fix a crossbar connecting each pair of neighboring legs of the table, and they are complemented with covering pieces for hiding them when not in use.

Additionally, on the upper base of each node or technical piece two circular holes are included, with diametrical splines, parallel to the frame, for respectively receiving cylindrical inserts, with one and a half perimetral grooves and having a threaded shaft or any other means to ensure their rigid fixation to the bottom side of the working board, in such a way that said inserts can be placed in the corresponding node or technical piece when both are in coaxial relationship; a blocking occurs when the node moves in one sense or the other, by means of an elongation or shortening of the frame as explained bellow.

The frame is structured by means of two lateral elements, each of them defining a kind of "U", with clearly truncated vertex, but in any case with the free ends of their lateral branches perfectly parallel and ending, thanks to its tubular configuration, by means of molded pieces, preferably made of zamak, which can be plugged vertically and slideably into the throttled opening of the technical pieces so as to define a tongued and grooved coupling with them, to ensure a good fixation of the frame to the legs, said fixation being reinforced by means of an insertable wedge in the internal cavity of said pieces. Said lateral elements are provided, at their middle zone, with a supporting plate, having an angular configuration, which vertical side includes a threaded hole, threaded in the right sense in one of the pieces and in the left sense in the other one, in such a way that a tensor rod connecting the same includes its respective screws, having also threads in opposite sense; after coupling the tensor rod to the lateral elements, turning said tensor rod in a determined sense produces a separation of said lateral elements and the turning in the opposite sense produces their approach. According to this configuration, once the pieces united to the working board have been assembled into the splined holes of the technical pieces, the elongation or shortening of the frame makes the perimetral slot of said pieces to become perfectly inserted in one of the ends of said holes, ensuring the perfect blockage of the whole.

Finally, said supporting plates included in the lateral elements of the frame are also provided, in their horizontal and upper side, with holes diametrically splined, similar to those of the technical pieces, through which the frame is fixed to the working board, by providing, in its bottom side, inserts similar to the ones used to fix the nodes to the technical pieces, so that an optimal structural strength of the table is achieved, after the tensioning of its frame.

DESCRIPTION OF THE DRAWINGS

In order to complement the present description and to achieve a better understanding of the features of the invention, according to a preferred embodiment of the same, a set of drawings is attached as a part of said description, said set of drawings being given for illustrative and not limitative purposes, in which.

PREFERRED EMBODIMENT OF THE INVENTION

Figure 1:
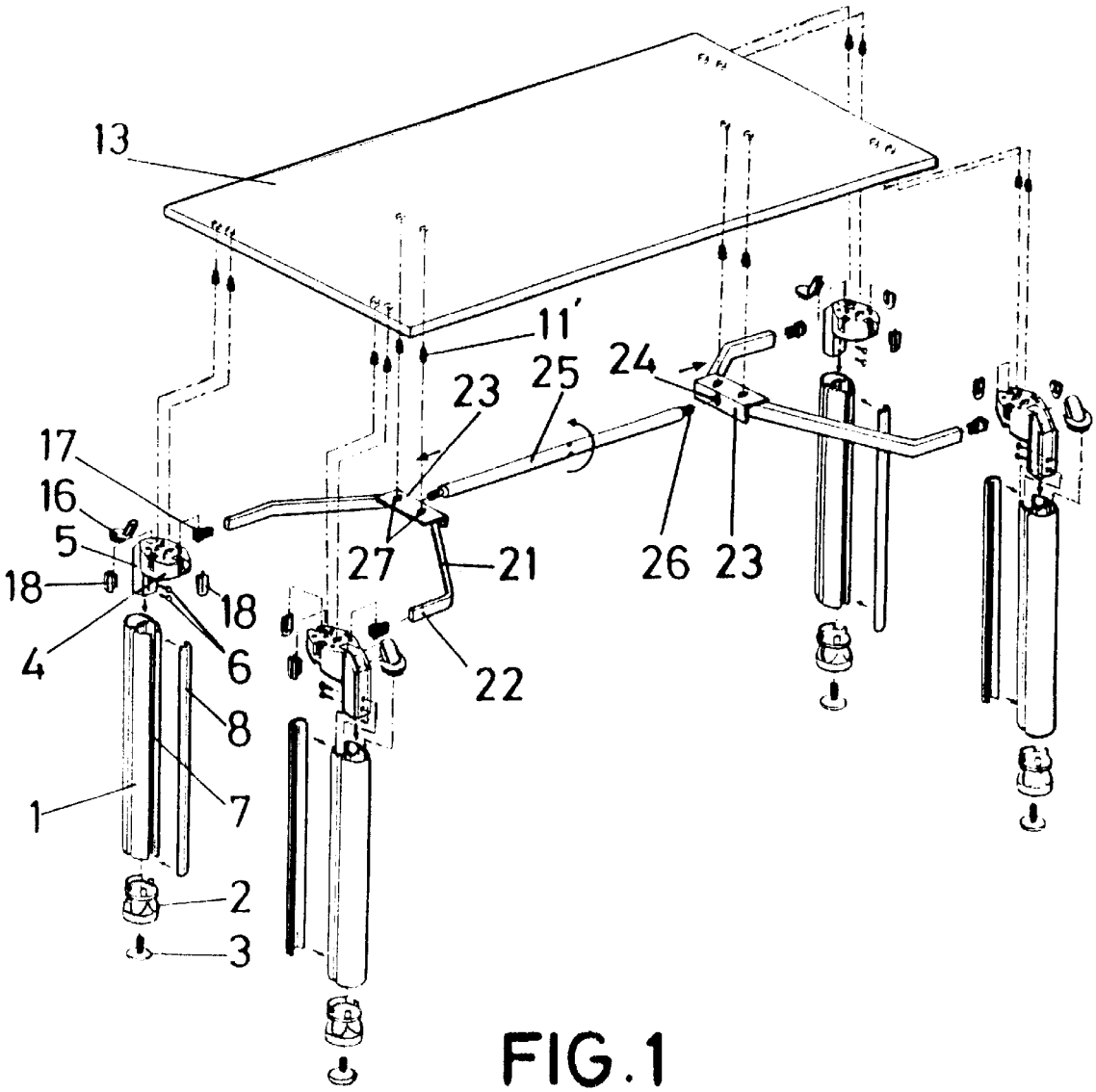
FIG. 1 shows a perspective exploded view of an office table made according to the object of the present invention.
Figure 2:
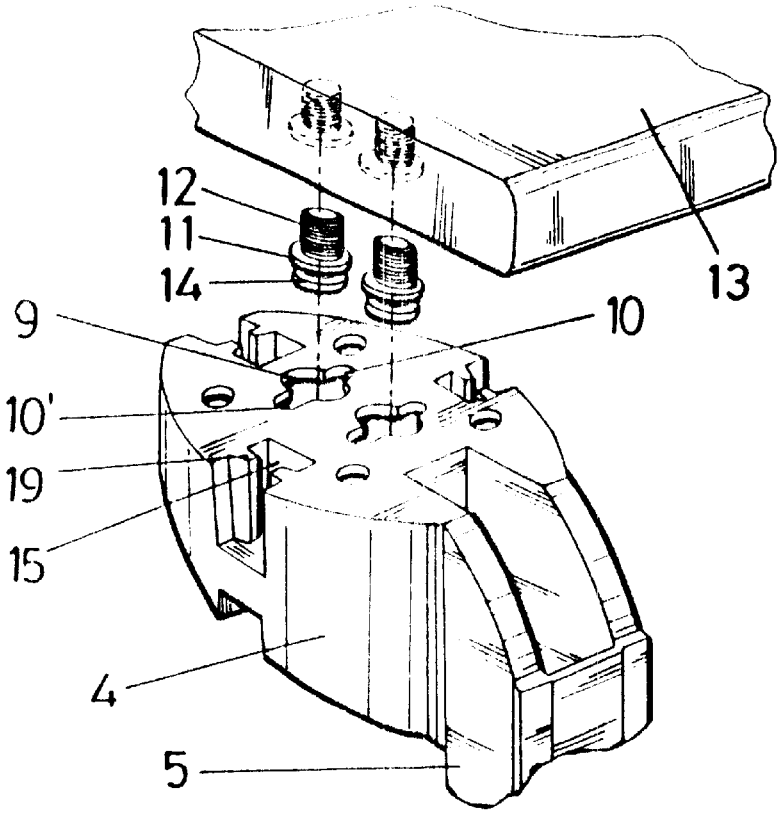
FIG. 2 shows a magnified detail of the coupling between the working board and one of the nodes or technical pieces.

According to the figures it can be seen that the structure of table according to the invention has four tubular legs (1) which lower ends receive a support (2) for a leveling piece (3), while the upper ends receive a node or technical piece (4) including a lower arm (5) which can be plugged inside the tubular leg (1) and which can be fixed with the aid of a pair of screws (6) which are accessible through a lateral slot (7) in the same leg (1) and which can be closed by means of a cover made of a profile (8) that can be pressed into the opening of said slot (7).

Each one of the nodes or technical pieces (4), which is hollow and open at the bottom, presents in the upper base a pair of holes (9) with a circular core, diametrically splined at the end sectors (10–10'), the diameter of the central core (9) corresponding to the diameter of the cylindrical inserts (11) having an inserting shaft (12) in the bottom side of the board (13), wherein said shaft can be threaded or provided with any other conventional joining and fastening means; in any case, the cylindrical inserts (11) include a perimetral groove (14) having a diameter coincident with the one of the elongations or slots (10–10') of the holes (9) so that once the inserts (11) are introduced in the holes (9), the displacement, in one sense or the other, of the nodes (4) causes the definite blocking of the same to the board (13) and therefore the blocking of the legs (1) to said board.

Figure 3:
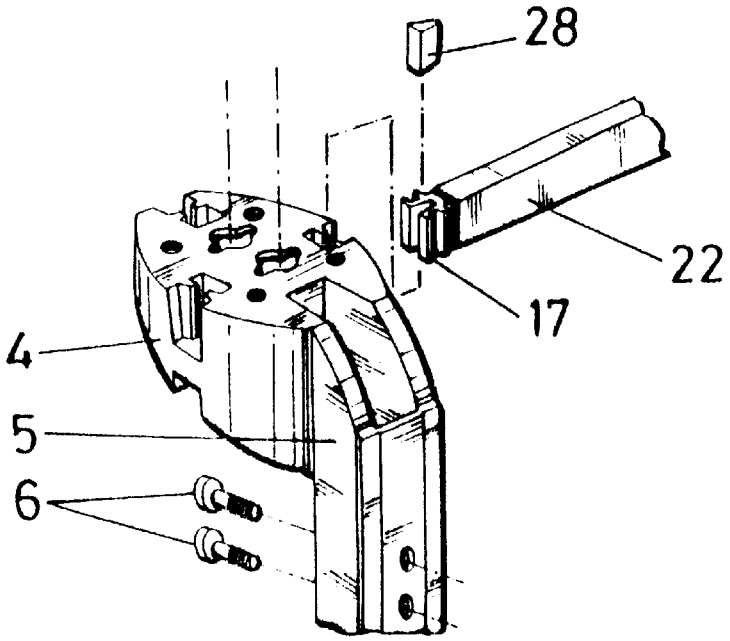
FIG. 3 shows another magnified detail, also in a perspective view, of the coupling to a node or technical piece of the correspondent part of the lateral element of the frame, in which the fixing means of the same node to the corresponding support have also been represented.
Figure 4:
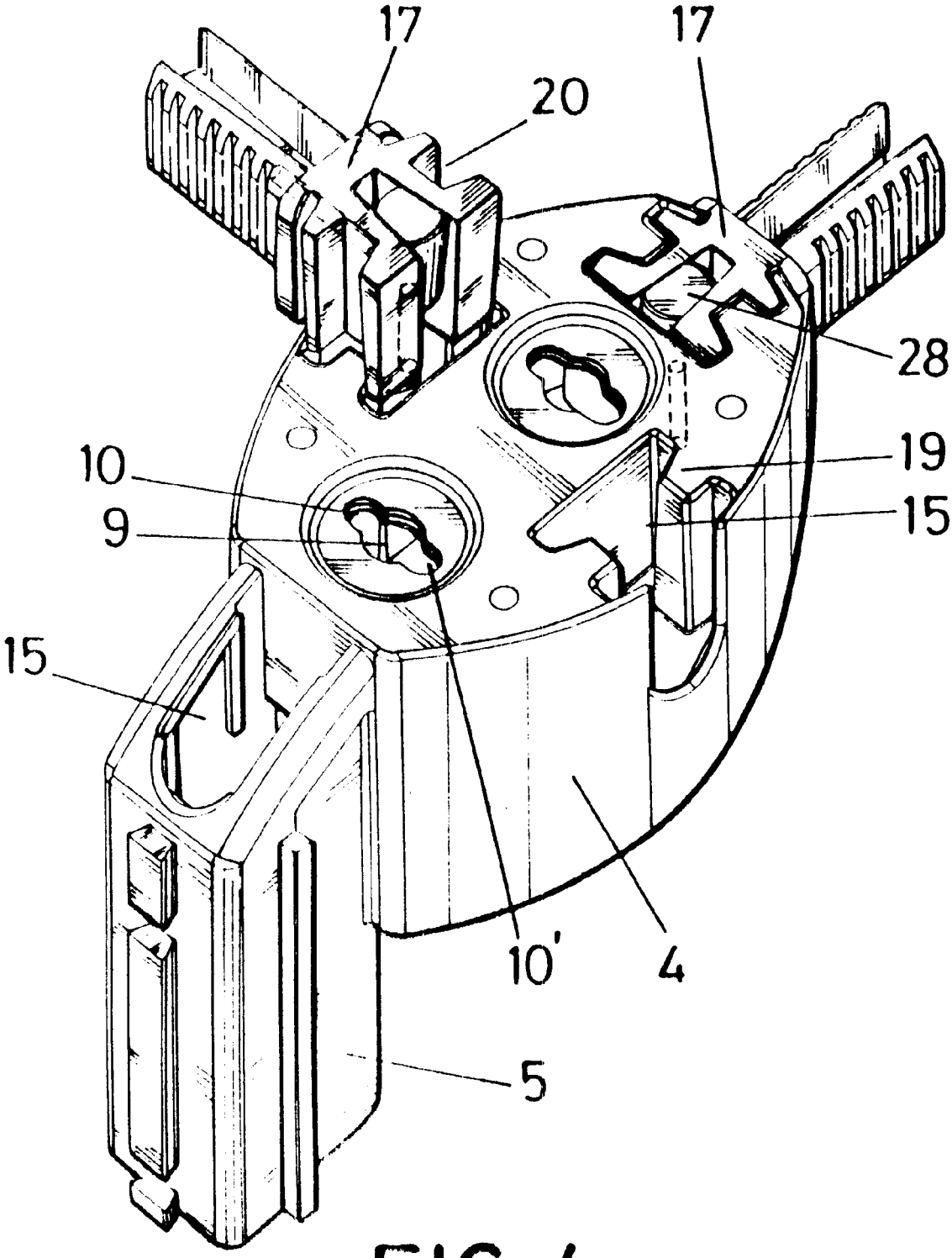
FIG. 4 shows a detail, in a perspective view, of one of the nodes or technical pieces, to which one of the molded pieces at the end of the lateral elements of the frame is totally coupled, while another similar piece is shown in its initial phase of coupling.

As a complement to the structure described above, each node or technical piece (4) includes additionally, in the lateral surface, four slots (15) distributed at the same angle, one of them being located in correspondence to the upper end of the arm (5), for receiving a trimming cover (16), while the other three are designed for receiving either molded pieces (17) associated to the structure of the frame, as described bellow, or trimming covers (18) when said slots (15) are not used; in any case said slots include a throttle (19) in the lateral walls to allow the tongued and grooved coupling of grooves (20) made in the pieces (17) and in the trimming covers (18); in this way, by means of a simple vertical plugging-in as shown in FIGS. 3 and 4, a perfect assembly of said pieces (17) to the node (4) is achieved and, consequently, of the frame to which said pieces (17) are fixed.

The frame is made of a pair of lateral elements (21) having any configuration but with parallel sectors (22) at the end of their lateral branches, spaced apart in accordance with the space foreseen between the corresponding legs (1), in such a way that the tubular structure of said lateral elements (21-22) receives by means of plugging under pressure the pieces (17), after which the union can be complemented with the aid of rivets, bolts, or any other means.

Each lateral element (21) includes at the middle zone an angular plate (23) provided with a centered hole (24) in the vertical side but with the special characteristic that, while the hole (24) of a plate (23) is threaded in the right sense, the other is threaded in the left sense, allowing the easy assembly of an intermediate tensor rod (25), ending at both ends with the correspondent screws or threaded shafts, having also opposite threads, in such a way that, when turning the tensor rod (25) in a determined sense the screws (26) penetrate in the threaded holes (24) and viceversa. Said screws (26) and holes (24) have a double functionality: they constitute the union link between the tensor rod (25) and the lateral elements (21) and they additionally bring closer or separate the nodes or technical pieces (4) in order to allow the transversal movement of their holes (9) in relation to the inserts (11) associated to the working board (13), for appropriate blocking of the same to the rest of the structure of the table.

The frame (21–25) is fixed to the nodes or technical pieces (4) and it is furthermore also fixed directly to the working board (13); to achieve this, the angular profiles (23) include respectively in their horizontal upper side a pair of holes (27) similar to the holes (9) of the nodes (4) and with the same configuration, in such a way that, with the aid of other inserts (11'), similar to the above described inserts (11), conveniently placed on the bottom side of the working board (13), the anchorage of the profiles (23) to the board and, consequently, to the frame as a whole, is produced, at the same time that the definitive fixation or anchorage of the nodes (4) to the board is produced.

Finally, in order to improve the fastening of the pieces (17) at the end of the frame to the correspondent nodes or technical pieces, said pieces (17) are provided with a yoke configuration in such a way that after its introduction in the corresponding slots (15) they are subjected to a lateral expansion due to the action of a wedge (28), and, as a result, the anchorage on the tubular legs (1) is produced.

What is claimed is:

1. A table comprising:

a working board comprising a bottom side with cylindrical inserts fixed to the bottom side, each of the cylindrical inserts having a perimetral groove;

a plurality of tubular legs with hollow interiors;

a plurality of nodes, each of the nodes connecting one of the legs to the bottom side of the board;

wherein each of the nodes comprises a lower arm, an upper base and a lateral surface;

the lower arm plugged into the hollow interior of one of the legs;

holes on the upper base coupling each of the nodes to one of the cylindrical inserts fixed to the bottom side of the board, each of the holes comprising diametrical slots having a width corresponding to a diameter of the perimetral groove of the insert so that relative displacement of the node and the connected leg achieves locking of the leg to the board; and a frame attached to the nodes and the bottom side of the board, the frame having a variable length;

the frame length being varied to displace and lock the nodes.

2. The table according to claim 1, wherein each leg further comprises a lateral slot for accessing screw heads fixed on the lower arm of the node, a cover coupled under pressure to close the slot and a leveling piece at a bottom end.

3. The table according to claim 1, wherein the lateral surface of each node includes slots with a throttle opening, open to the upper base of the node, fixing by tongued and grooved coupling the frame and having trimming covers sealing slots not in use.

4. The table according to claim 3, wherein the frame comprises two lateral elements having a tubular configuration, in which lateral branches are defined having parallel ends, to which injected pieces are plugged in and fixed to obtain a tongued and grooved coupling of the frame to the nodes, each lateral element being provided at a middle zone with an angular plate having in a vertical side a centered hole for coupling an intermediate tensor rod, connecting both lateral elements, and being provided with threaded ends.

5. The table according to claim 4, wherein the angular plates include in horizontal and upper sides a pair of holes and inserts passing through the holes attaching the frame to the bottom side of the board.

* * * * *